US007377044B2

(12) United States Patent
Economaki

(10) Patent No.: US 7,377,044 B2
(45) Date of Patent: May 27, 2008

(54) ARTICULATED IRON CAP FOR A HAND PLANE

(75) Inventor: John J. Economaki, Lake Oswego, OR (US)

(73) Assignee: Fine Tools, LLC, Des Moines, IA (US)

( * ) Notice: Subject to any disclaimer, the term of this patent is extended or adjusted under 35 U.S.C. 154(b) by 152 days.

(21) Appl. No.: 11/214,385

(22) Filed: Aug. 29, 2005

(65) Prior Publication Data

US 2006/0101654 A1 May 18, 2006

Related U.S. Application Data

(63) Continuation-in-part of application No. 10/992,583, filed on Nov. 18, 2004.

(51) Int. Cl.
*B27G 17/02* (2006.01)

(52) U.S. Cl. ..... 30/492; 144/115

(58) Field of Classification Search ..... 30/492, 30/487–489; 144/115
See application file for complete search history.

(56) References Cited

U.S. PATENT DOCUMENTS

| | | | | |
|---|---|---|---|---|
| 453,524 | A | 6/1891 | Tuoti | |
| 932,417 | A * | 8/1909 | Shontz | 30/485 |
| 1,053,270 | A * | 2/1913 | Bodmer et al. | 30/492 |
| 1,069,669 | A * | 8/1913 | Bodmer et al. | 30/492 |
| 1,149,703 | A | 8/1915 | Vaughan | |
| 1,157,594 | A | 10/1915 | Selleck | |
| 1,324,486 | A * | 12/1919 | Allen | 30/492 |
| 1,507,722 | A | 9/1924 | Ahlen | |
| 1,559,797 | A | 11/1925 | Slomer | |
| 1,776,661 | A | 9/1930 | McCue | |
| 1,822,520 | A | 9/1931 | Fox | |
| 1,918,750 | A * | 7/1933 | Higbee | 30/488 |
| 4,015,649 | A | 4/1977 | Gilbert | |
| 4,589,209 | A | 5/1986 | Zarges et al. | |
| 2005/0061398 | A1 * | 3/2005 | Saunders | 144/115 |
| 2005/0188553 | A1 | 9/2005 | Lee et al. | |

* cited by examiner

*Primary Examiner*—Kenneth E. Peterson
(74) *Attorney, Agent, or Firm*—McKee, Voorhees & Sease, P.L.C.

(57) ABSTRACT

This invention relates to an articulated iron cap for a hand plane. The iron cap pivotally mounts to a hand plane. The iron cap for the hand plane mates to either a beveled down iron or a bevel up iron. One embodiment of the invention has a chip breaker for engaging the iron where the chip breaker pivots approximately perpendicular to the longitudinal axis of the hand plane. A nose piece on the chip breaker may be configured to extend and pivot so as to align with the grind angle on the iron. This invention places a mass near the cuffing edge of the iron which allows for preloading the iron and dampening vibration of the iron. In turn, this all creates a smoother more accurate cut and requires less effort to use.

9 Claims, 10 Drawing Sheets

ARTICULATED IRON CAP FOR A HAND PLANE

CROSS-REFERENCE TO RELATED APPLICATIONS

This application is a Continuation-in-Part and claims priority under 35 U.S.C. § 119 of U.S. application Ser. No. 10/992,583 filed Nov. 18, 2004, which application is hereby incorporated by reference in its entirety.

BACKGROUND OF THE INVENTION

This invention relates to woodworking tools. Specifically, this invention relates to an articulated iron cap for a hand plane.

Hand planes have been used for hundreds of years to smooth the surface of wood. A hand plane works when a woodworker pushes or pulls the plane across the surface of the wood which allows the sharp blade or the plane iron to engage the wood and shear off a thin layer of wood, thereby smoothing the wood surface.

FIG. 1 shows an expanded view of a prior art hand plane. The hand plane assembly 10 has a base unit 12, in which the bottom of the base unit 12 is the sole 14. In addition, the base unit 12 has an opening in the sole 14 which is called the throat 16. Attached to the base unit 12 is at least one handle or tote 18. A device called a frog 20 extends upward from the inside of the base unit 12. The frog 20 holds the blade or cutter which is known as the iron 28. The user can turn the depth adjuster 22 which allows the iron 28 to extend farther through the throat 16. Adjustment of the iron 28 depth allows the iron 28 to engage a deeper or shallower cut in the wood being planed. The lateral adjuster 24 allows the user to adjust the iron 28 into a left or right position. This in turn, allows for deeper cuts on one side of the plane or the other. A bolt inserted near the center of the frog 20 is called the fulcrum stud 26. This stud 26 allows the iron 28 to be fastened securely to the frog 20, so as to make a secure, tight fit which holds the iron 28 in place during use.

In order for the iron 28 to be of use, it must be sharpened. The sharpened area on an iron 28 is called the bevel 29. Most prior art hand planes are designed in one of two ways. They either have the iron bevel up, or the bevel down in relation to the sole 14 of the plane. Typically planes that have a down bevel are similar to the design shown in the hand plane assembly 10. On the other hand, common bevel up irons are used in a different style of hand plane (not shown) which do not have the frog. Instead, the iron 28 lays on an inclined surface on the inside of the base unit 12 without the aid of the frog 20. This allows a bevel up iron 28 to lie at a much more reclined angle inside the base unit 12 of the plane.

A prior art bevel up type iron 28 plane which is not shown, is commonly known to one skilled in the art. A bevel up iron 28 allows a user with the much more inclined angle on the iron 28 to use the plane in more difficult types of wood. The sharper attack angle allows the plane to cut woods with more difficult grain. Thus, each type of plane, bevel up or bevel down, has its own specific purpose.

A cap iron 30 is used in conjunction with the iron 28 on bevel down type planes. The cap iron 30 is secured to the iron 28 by the use of a cap iron screw 36. This cap iron 30 acts as a chip breaker which helps to curl the cuttings cut by the iron 28 before they have a chance to split away from the larger working piece of wood. The end result is that the chip breaker part 38 on forward end of the cap iron 30 as seen in FIG. 1A, which is the rounded-out bottom portion of the cap iron, is desirable in bevel down type irons 28. Overall, the chip breaker contributes for much smoother cutting on the work surface of the wood. The iron 28 and the cap iron 30 when bolted together by the use of the cap iron screw 36 become one piece, which is held onto the frog 20 by the use of the lever cap 32. This lever cap has a lever 34 with a cam on the end which applies pressure against the cap iron 30 to hold the cap iron 30 and the iron 28 assembly in place on top of the frog 20. The cam on the bottom of the lever 34 causes the lever cap 32 to pivot around the fulcrum stud 26 and remain tight on the cap iron 30 and iron 28 assembly.

Typically, most lever caps 32 are of solid construction cast metal with the only moving part as the lever 34. This allows for a solid lever action while pivoting at the fulcrum stud 26 to allow force on the cap iron 30 to hold it tight. However, other types of lever caps 32 have been developed. For example, U.S. Pat. No. 1,822,520 discloses a clamping lever assembly 40 which is seen in FIGS. 2, 3 and 4. This clamping lever assembly 40 was comprised essentially of two main sections, the clamping lever main body 44 and the clamping lever tip 46. On the back side near the lever 34 is a spring 42 which helps to hold the lever 34 into place which maintains pressure or tension on the cap iron 30 and iron 28 assembly. The clamping lever main body 44 and the clamping lever tip 46 are held together by a rivet which is loosely fit and allows the clamping lever tip 46 to move a little with respect to the clamping lever main body 44. On the bottom of the clamping lever tip 46 are two lugs 48. These lugs also engage the cap iron 30 and iron 28 assembly to apply pressure to the assembly to hold it tight on the plane. The bearing edge 50 is what contacts the cap iron 30 to apply pressure to the iron 28 to hold it tight during operation of the plane. Here again, a fulcrum stud 26 goes through the fulcrum slot 52 to allow the assembly to mount together.

One of the problems with existing planes is that frogless planes lack a chip breaker. This can cause a "lever-effect" of a shaving and wood can be "torn" out ahead of the cut. The result is an undesirable rough cut. Another problem with this type of assembly of the prior art, is that the pressure from the lever cap 32 or the clamping lever assembly 40 is applied to the cap iron behind the cutting edge of the iron 28. This allows the cutting edge of the iron 28 to vibrate and contributes to rough cuts. This creates opportunities for vibration and flex of the iron 28. This leads to chatter in thin cuts as the iron 28 loads and depends on the user to maintain a rigorous and forceful motion to keep the iron loaded during use. Every cutting edge, whether in wood or metal, needs a load (or bite) to work properly. With hand planes, the load occurs when the cutting edge first encounters the material to be cut. The edge of the blade or iron 28 deflects slightly and as long as there is significant forward motion of the plane, the iron 28 remains loaded and cuts the material.

The primary object of the present invention is to provide an improved plane iron cap.

It is a further object of this invention to allow the iron to be tensioned or loaded while locked in place.

It is a further object of this invention to create the ability to vary the depth of the cut while the iron is locked in place.

It is a further object of this invention to add mass and tension to the area of the iron that is unsupported in traditional planes therefore making the iron more rigid.

It is a still further object of the invention to create a plane which dramatically dampens vibration during use.

It is a further object of the invention to create a cap iron which also functions as a chip breaker.

It is a further object of the invention to eliminate the need to separate the iron from the chip breaker on the cap iron prior to sharpening.

It is a still further object of the invention to create a seal between the iron and the chip breaker which eliminates tuning of new planes and prevent chips from becoming lodged between the chip breaker and the iron.

It is a still further object of the current invention to allow bevel up planes to have the aid of a chip breaker.

It is a still further object of the invention to minimize grain lift when using the plane to plane wood.

It is a further object of the invention to allow the cap iron to seat throughout the entire lateral adjustment range of the iron.

It is a further object of the invention to allow the cap to seat against the iron regardless of the primary grind angle or bevel on the iron.

It is a still further object of the invention to add mass to the cutting edge of the iron to act as a vibration dampener.

It is a still further object of the invention to create a plane which can eliminate the use of a frog while still having a chip breaker.

It is a further object to move the flexing point of the iron from the fulcrum stud down closer to the cutting edge of the iron.

A further object is the provision of the articulated plane iron cap which is economical to manufacture, durable in use, and efficient in operation.

One or more of these or other objects of the invention will be apparent from the specification and claims that follow.

SUMMARY OF THE INVENTION

The foregoing objects may be achieved by creating a hand plane with a base unit configured for holding an iron wherein the base unit is comprised of a sole and a throat and the iron is configured with a beveled edge which can extend through the throat of the base unit and an articulated iron cap is used to position the iron through the base unit wherein the iron cap is configured to pre-load the iron and also to act as a chip breaker.

A further feature of the present invention involves an iron cap which has a pivoting dampner with an extendable pressure bar which traverses in and out of the dampner for engaging the iron and dampering vibration in the iron.

A further feature of the present invention involves a hand plane, wherein the iron is configured as either an up beveled iron or a down beveled iron.

A further feature of the present invention involves a hand plane, wherein the iron cap is pivotally mounted to the base unit.

Another feature of the present invention involves a hand plane, wherein the iron cap is further comprised of a two axis or a three axis chip breaker, and the chip breaker self-aligns with the grind angle on the iron.

A still further feature of the present invention is a hand plane wherein the chip breaker is further comprised of a button or a rib, which is configured so as to apply pressure against the iron to pre-load the iron.

A further feature of the present invention involves a hand plane, wherein the throat is configured as an adjustable throat.

A still further feature of the present invention involves a hand plane, wherein the chip breaker is further comprised of a button or a rib, which is configured so as to apply additional pressure directly behind the bevel to pre-load and dampen the iron.

The foregoing objects may also be achieved by creating an iron cap for a hand plane comprising a means for pivotally mounting to a hand plane, an articulating means for tensioning an iron in the hand plane, whereas the articulating means is further configured as a chip breaker.

A further feature of the present invention involves an iron cap for a hand plane wherein the iron cap is configured to mate to a bevel down iron or a bevel up iron.

A further feature of the present invention is an iron cap for a hand plane wherein the chip breaker is configured with a two or three dimensional axis for engaging the iron plane.

A further feature of the present invention involves the iron cap for a hand plane wherein the chip breaker is configured to pivot approximately perpendicular to the longitudinal axis of the hand plane so as to adjust to the angle, or pitch of the iron.

The foregoing objects may also be achieved by a hand plane configured to have a base unit with a sole and a throat, at least one handle attached to the base unit, a beveled iron for extending through the throat on the base unit and an iron cap, wherein the iron cap comprises a means for pivotally attaching to the base unit, a means for engaging the beveled iron, and an articulated chip breaker.

A further feature of the present invention involves a hand plane wherein the iron cap articulates relatively perpendicular to the longitudinal axis of the hand plane.

A further feature of the invention is a hand plane wherein the iron cap further comprises a nose piece, wherein the nose piece is configured to pivot so as to engage varying grind or bevel angles of the iron.

A further feature of the present invention involves a hand plane wherein the iron cap further comprises a button, wherein the button is configured to apply additional pressure on the iron.

A further feature of the present invention is a hand plane wherein the iron cap further comprises a raised rib, wherein the rib is configured to apply additional pressure to the iron.

A further feature of the invention is a hand plane wherein the iron cap further comprises a nose piece, wherein the nose piece is configured to pivot so as to engage tightly regardless of the varying grind or bevel angles of the iron, or manufacturing tolerances.

There are several words that need to be defined for the purpose of this invention. This invention is entitled an Articulated Iron Cap for a Hand Plane. The word articulated simply means that the iron cap has joints or segments and is capable of having rotating parts. Another word that needs to be defined is loading. This invention refers to loading of the plane iron. Loading simply means applying pressure against the iron so as to push the lower end of the iron down and back towards the rear of the throat of the base unit with pressure as much as or greater than the pressure that would be applied as the iron is driven into the wood in which it is to cut where the wood would be pushing against the lower edge or the cutting edge of the iron. The current invention allows for the iron to be pre-loaded with a force as much as or greater than the load force of standard hand planes, thereby significantly reducing any flexing, chatter or vibrating of the iron during use. The pre-loading of the iron in the current invention allows for a much smoother cut because the iron does not flex when it is driven into the wood that is being worked. In addition, this pre-loading force allows the depth of cut to be adjusted by adding more loading force to the iron by further tightening a tensioning bolt. In fact, the depth of cut can be finely adjusted up to approximately 0.003" (0.0762 mm) in this manner.

Another word that needs defined is iron. Iron does not refer to the type of material or element in which the current invention is made of. Rather, iron is a term commonly known in the art for the blade or the cutting device which actually cuts the wood for a hand plane. Therefore, a cap iron (or iron cap) is a cap that simply goes over the top of the iron, which can be made of many different materials including steel, cast iron, brass, or other similar metals.

DETAILED DESCRIPTION OF THE PREFERRED EMBODIMENT

Figure 1:
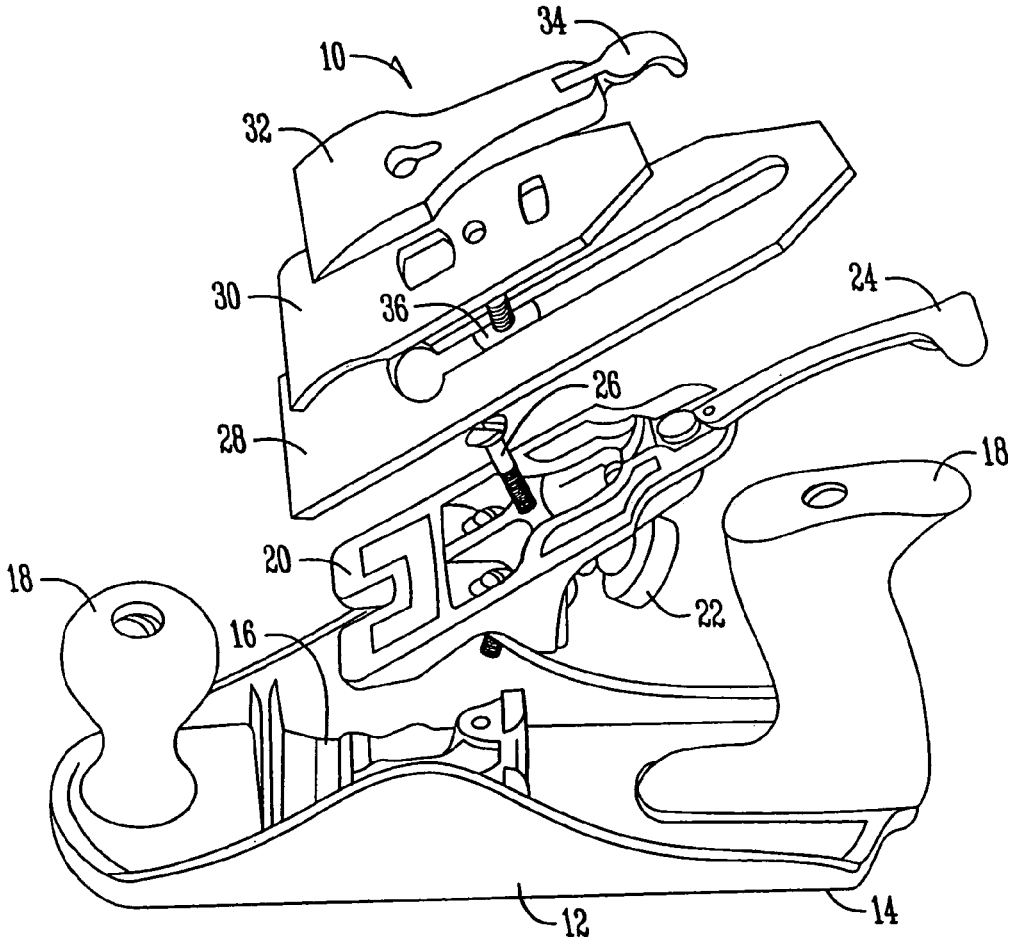
Fig. 1 (PRIOR ART)
FIG. 1 is an expanded view of a typical hand plane in the prior art.
Figure 1A:
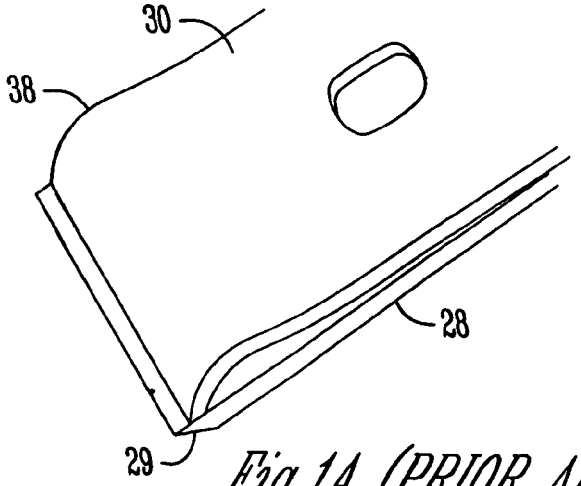
Fig. 1A (PRIOR ART)
FIG. 1A shows a lower portion of the assembly between a cap iron and the iron of the prior art.
Figure 2:
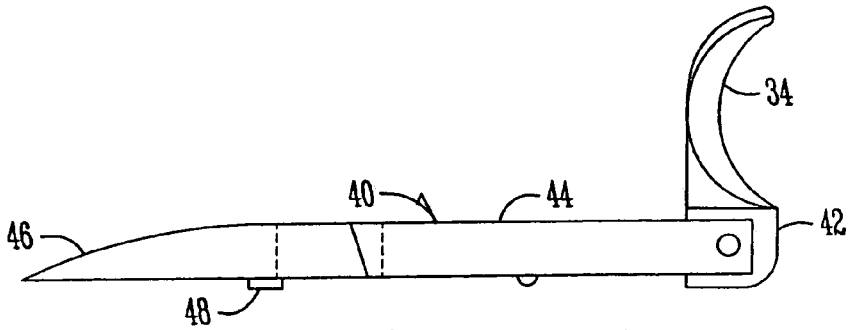
Fig.2 (PRIOR ART)
FIG. 2 shows a side view of an alternative jointed cap iron in the prior art.
Figure 3:
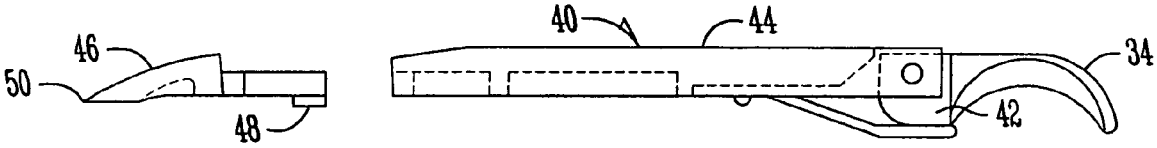
Fig.3 (PRIOR ART)
FIG. 3 shows an expanded side view of an alternative cap iron in the prior art.
Figure 4:
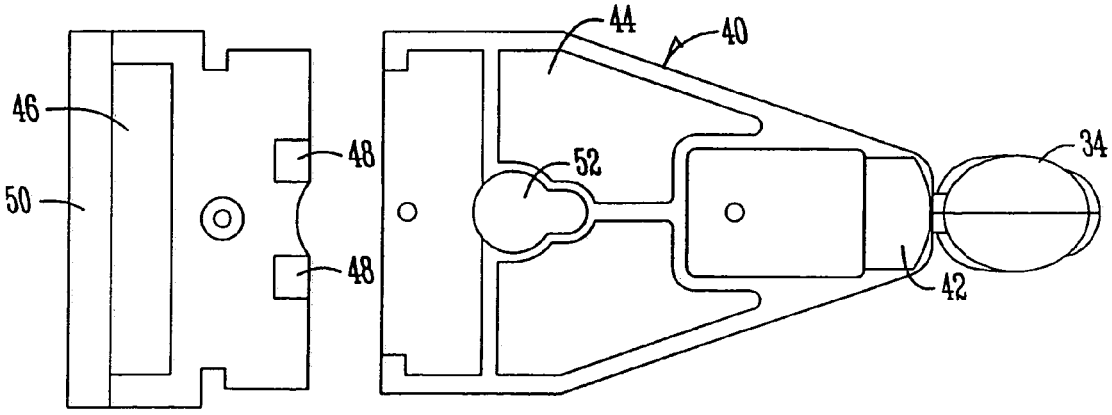
Fig.4 (PRIOR ART)
FIG. 4 shows the bottom view of an expanded alternative cap iron in the prior art.
Figure 5:
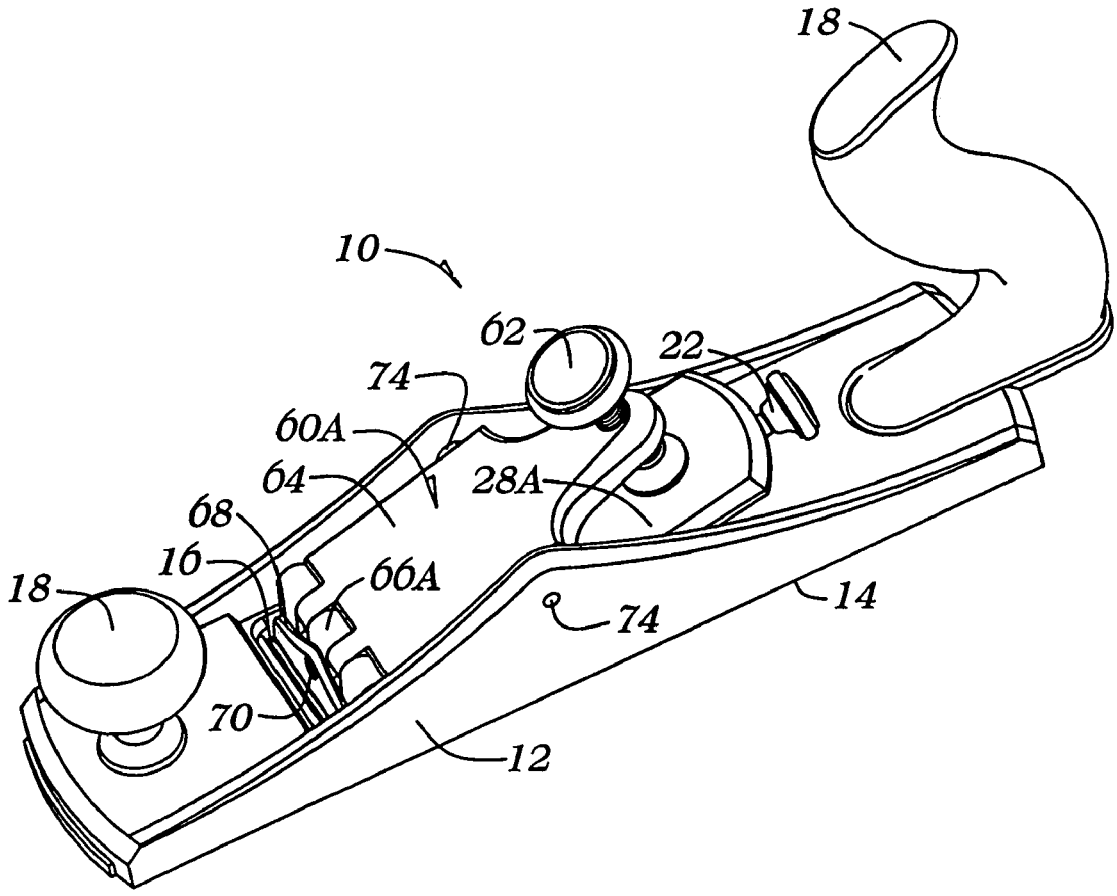
FIG. 5 shows an isometric view of one embodiment of the current invention used in a hand plane.

The invention is an articulated hand plane iron cap for use on a woodworking plane. One embodiment of the invention is shown in FIG. 5. This embodiment of the plane does not incorporate a frog 20, as is incorporated in the prior art, however, a frog 20 could be used with the current invention.

This embodiment of the invention is constructed with a base unit 12 in which the underside of the base unit 12 is called the sole 14. An opening in the sole 14, is a throat 16. The throat 16 can be configured as an adjustable throat, as is common in the art. Attached to the base unit 12 is also one or more totes or handles 18. The totes 18 allow the user to grip the plane so they can push or pull the plane over the wood surface to be planed however, totes 18 are not necessary. The bevel up iron 28A rests on the depth adjuster 22 and a portion of the base unit 12 and extends through the throat 16. The iron 28A is held to the base unit 12 by the articulated iron cap assembly 60A. The articulated iron cap assembly 60A is constructed with an iron cap main body 64 which pivotally mounts to the base unit 12 by the iron cap assembly main pivots 74. These iron cap assembly main pivots 74 allow the articulated iron cap assembly to pivot back and forth along the iron cap assembly main pivot 74 axis.

When the tensioning bolt 62 is screwed into the iron cap main body 64, it applies pressure to the iron 28A. The articulating chip breaker 66A, which is pivotally attached to the iron cap main body 64, then moves downward after the articulated iron cap assembly 60A pivots about the iron cap assembly main pivot 74. Attached to the articulating chip breaker 66A is a nose piece 68. As the tensioning bolt 62 is screwed tighter into the iron cap main body 64, the nose piece 68 engages the iron 28A. The tighter the tensioning bolt 62 is tightened, the tighter the pressure that is held on the iron 28A. This pressure or loading allows the articulated iron cap assembly 60A to hold the iron 28A into the base unit 12 of the plane.

The articulated iron cap assembly 60A of the current invention allows a hand plane to have a chip breaker 66A without the use of a cap iron 30. This chip breaker 66A applies pressure at the very bottom end, near the cutting edge of the iron 28A. Putting pressure at the very bottom end directly on the iron 28A allows the articulated iron cap assembly 60A to hold the iron 28A extremely steady which reduces vibration on the iron 28A, which in turn creates a better cut with the plane. In addition, the articulating chip breaker 66A adds a large mass coupled directly near the cutting edge of the iron 28A which further reduces vibration of the iron 28A and additionally creates a smoother, more accurate, and better cut.

Figure 6A:
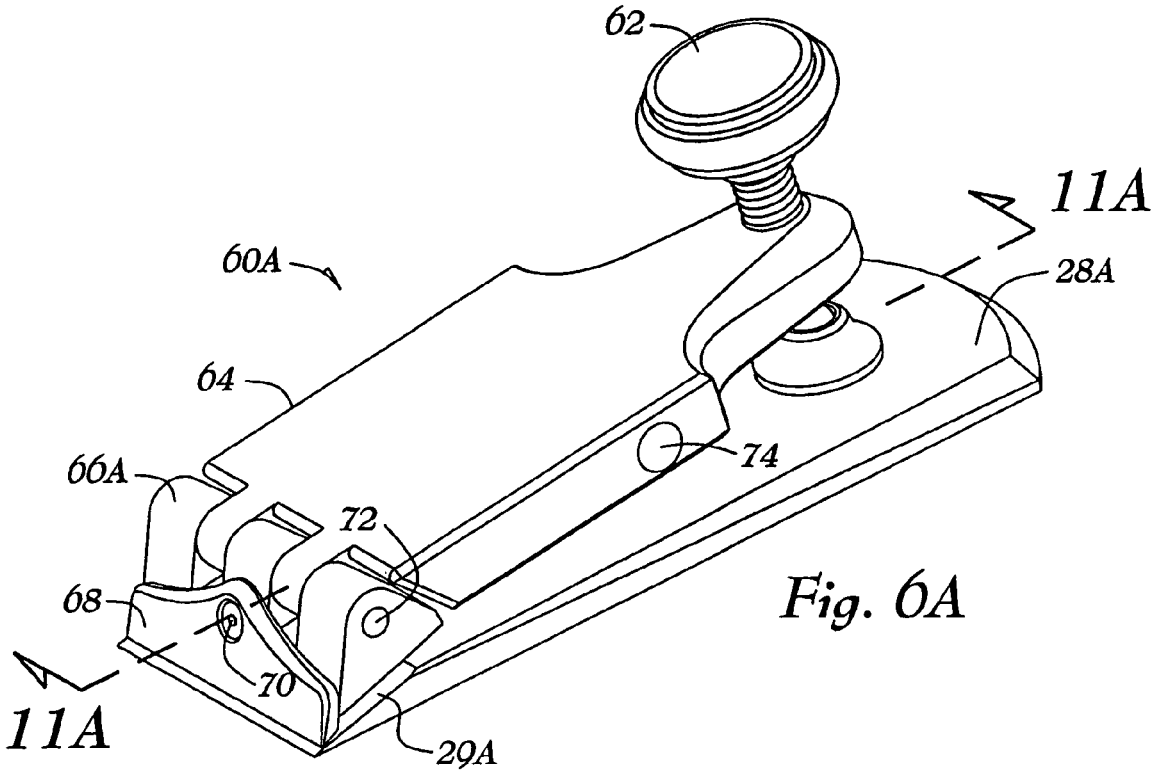
FIG. 6A shows an embodiment at an articulated plane iron cap of the current invention engaging a bevel up iron.

As seen in FIG. 6A, the iron 28A for this embodiment of the invention has an up bevel 29A. As discussed above, the iron 28A is cradled in the base unit 12 and held tightly by the tensioning bolt 62 and the nose piece 68. The pivoting or articulating of the articulating chip breaker 66A allows the chip breaker 66A and the nose piece 68 to pivot so as to engage the bevel 29A of the iron 28A. FIGS. 6C and 6D show another embodiment of the invention, with an extendible nose piece pressure bar 68C iron cap assembly 60C. FIG. 6C shows an up bevel iron 29A and FIG. 6D shows a down bevel iron 29B.

Figure 7A:
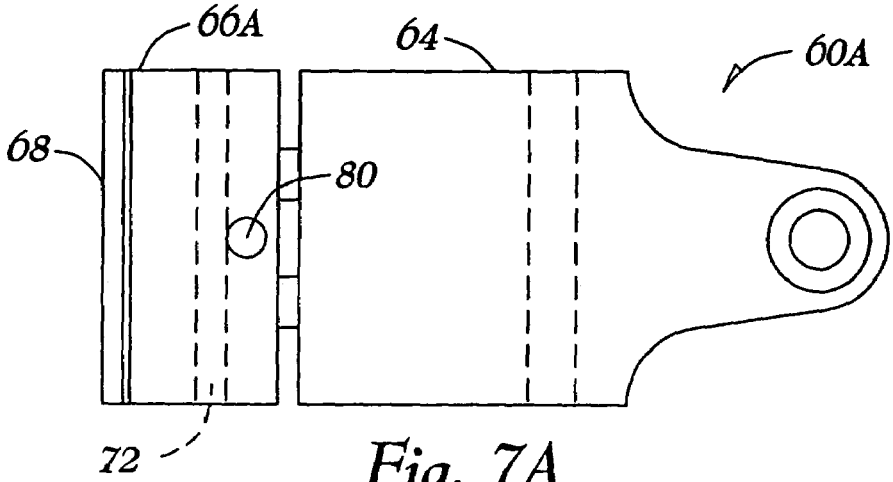
FIG. 7A shows the bottom view of an articulated iron cap assembly used for a bevel up plane.
Figure 8A:
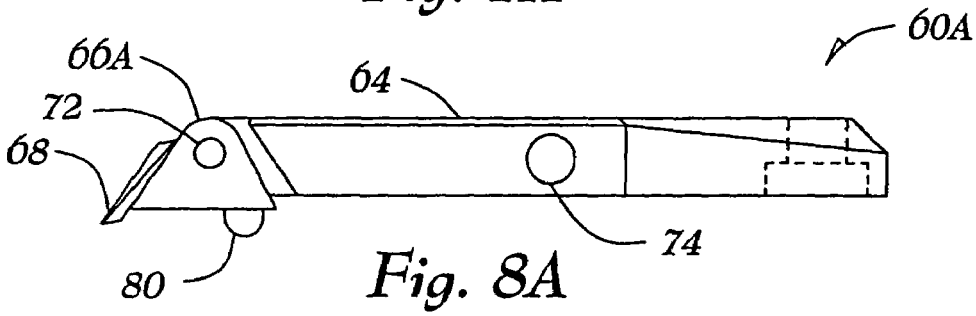
FIG. 8A shows a side view of an articulated iron cap assembly for a bevel up plane.

As seen in FIGS. 7A and 8A, the articulating chip breaker 66A comprises a tension button 80 on the underneath side of the articulating chip breaker 66A. The combination of the rounded button 80 and the pivoting nose piece 68 allows for a positive engagement on an upper bevel 29A iron 28A, even if the bevel of iron 28A is skewed off center of the longitudinal axis of the plane. The preferred embodiment of the button 80 is rounded, but it can be other shapes. The nose piece 68 pivots along the nose piece pivot 70. The chip breaker 66A provides a function of reducing the "lever effect" of a shaving which can create a situation where the wood is "torn" ahead of the cut. Thus, the chip breaker 66A creates a smoother surface on the planed wood.

Figure 6B:
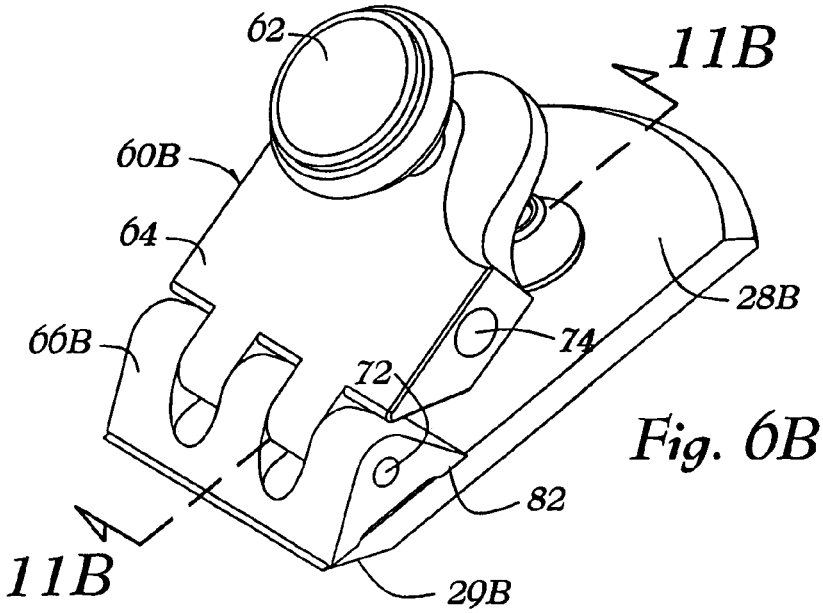
FIG. 6B shows an alternative embodiment of an articulated plane iron cap invention engaging a bevel down iron.
Figure 6C:
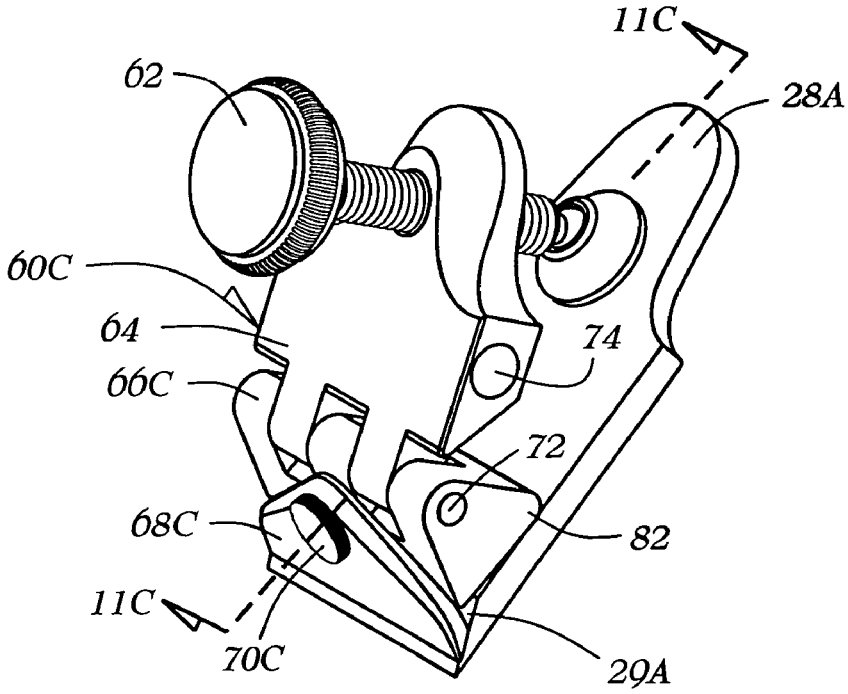
FIG. 6C shows another embodiment of an articulated plane iron cap of the current invention engaging a bevel up iron.
Figure 6D:
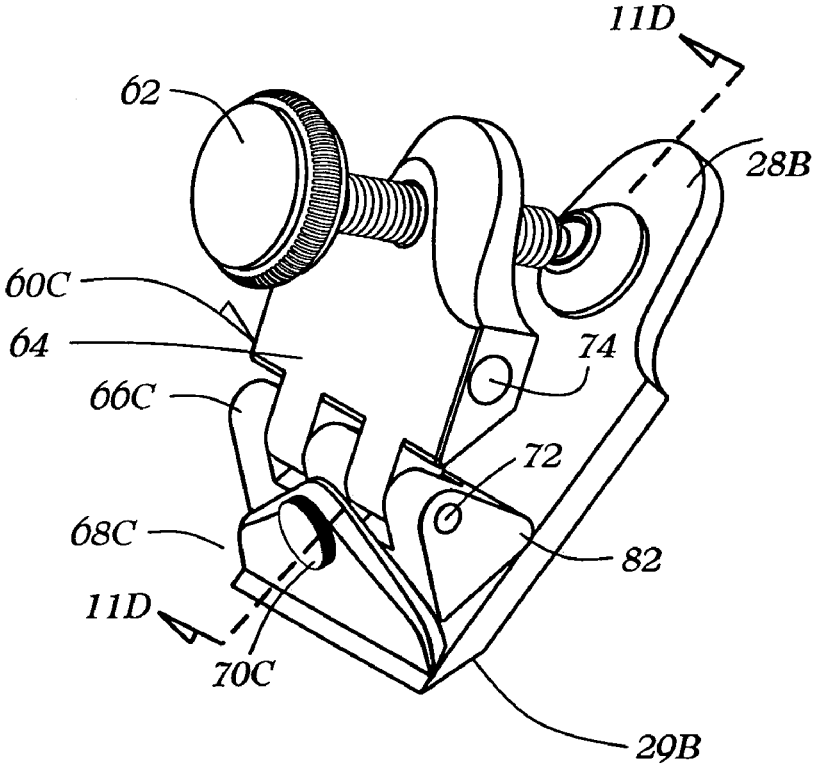
FIG. 6D shows another embodiment of an articulated plane iron cap of the current invention engaging a bevel down iron.
Figure 7B:
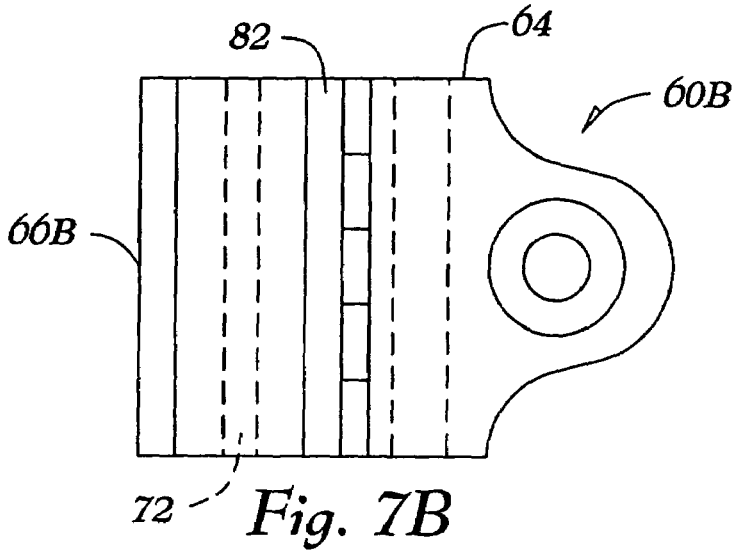
FIG. 7B shows the bottom view of an articulated iron cap assembly used for a bevel down plane.
Figure 8B:
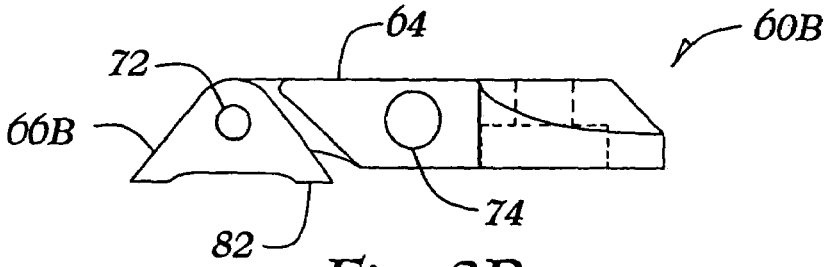
FIG. 8B shows a side view of an articulated iron cap assembly for a bevel down plane.
Figure 7C:
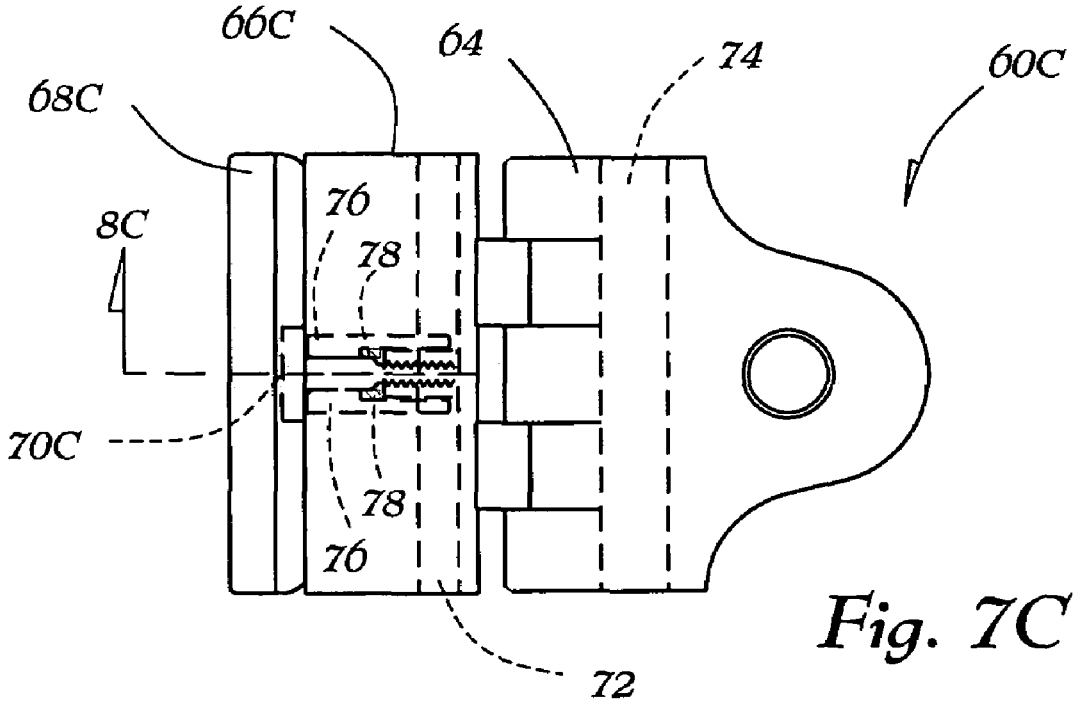
FIG. 7C shows a bottom view of another embodiment of an articulated iron cap assembly.
Figure 8C:
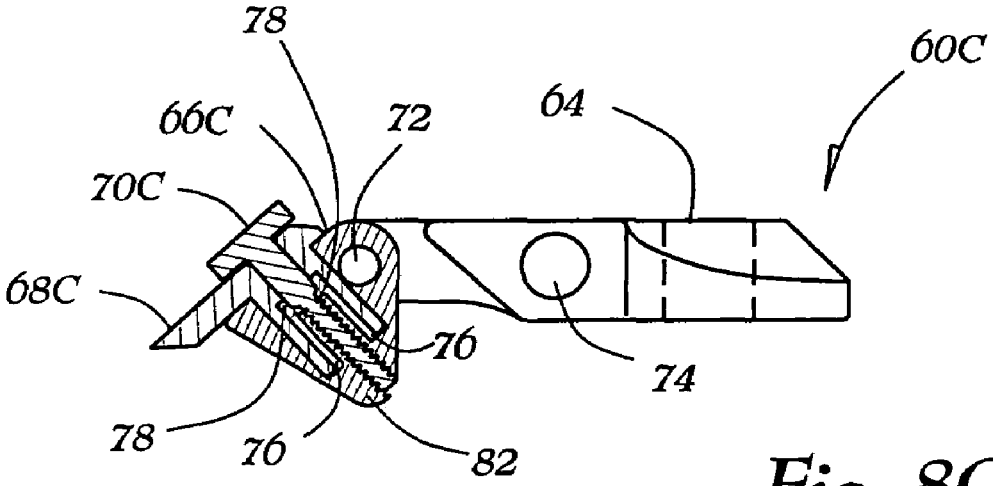
FIG. 8C shows a side view of another embodiment of an articulated iron cap assembly.

Another embodiment of the current invention is shown in FIGS. 6B, 7B and 8B. Here the iron 28B shown is a bevel down 29B iron. The bevel 29B is on the bottom side of the iron. Since the bevel 29B is now on the bottom side, the articulated iron cap assembly 60B is able to engage a flat surface of the iron 28B rather than having to accommodate for the bevel of an up bevel iron such as 28A. Since the articulated iron cap assembly 60B is engaging a flat surface on the iron 28B, the articulated chip breaker 66B no longer needs the three dimensional pivoting. Rather, the articulating chip breaker 66B only needs to pivot along the chip breaker pivot 72. The articulating chip breaker 66B as seen in FIGS. 7B and 8B has a tension rib 82 as opposed to the tension button 80. This tension rib 82 follows along the surface of the iron 28B and pivots the articulating chip breaker 66B along the chip breaker pivot 72 and causes both the tension rib 82 and the bottom edge of the articulating chip breaker 66B to engage the iron 28B. The preferred embodiment of the tension rib 82 is flat, but can be other shapes. This engagement holds the iron 28B in place when the articulated iron cap assembly 60B is tightened to the iron 28B by using the tensioning bolt 62 as discussed above where the articulated iron cap assembly 60B pivots about the iron cap assembly main pivot point 74 to hold the iron 28B tight against the inner bed of the main base unit 12.

The embodiment of the invention shown in FIGS. 6C and 6D with bevel up iron 29A and bevel down iron 28B respectively is also shown in FIGS. 7C, 8C, 11C and 11D. This embodiment has an extendible nose piece or pressure bar 68C which extends in and out of the articulating chip breaker/dampner 66C. This works similar to the embodiments shown in FIGS. 5, 6A, 7A, 8A and 11A, but in this embodiment the pressure bar 68C is extendible from the dampner 66C. This allows pressure to be placed on the iron 28 further from the tension button 80 or tension rib 82. This greater distance increases leverage thereby increases loading capability on the iron 28. Additionally, having an extendible pressure bar 68C allows for engaging the iron 28 closer to the cutting edge when the iron 28 is extended further through the throat 16.

The current invention allows the chip breaker 66A and 66B to be pivotally attached to the iron cap main body 64 and eliminates the need for a cap iron 30 of the prior art. Thus, sharpening of the iron 28A and 28B can be done without having to follow the extra step of removing a cap iron 30. In addition, having the extra mass of the chip breaker 66A and 66B applying pressure near the bottom cutting edge of the iron 28A and 28B allows extra mass to be added to the lower end of the iron 28A and 28B near the cutting edge which reduces vibration and creates a smoother, better cut of the wood being planed with less effort.

Figure 9:
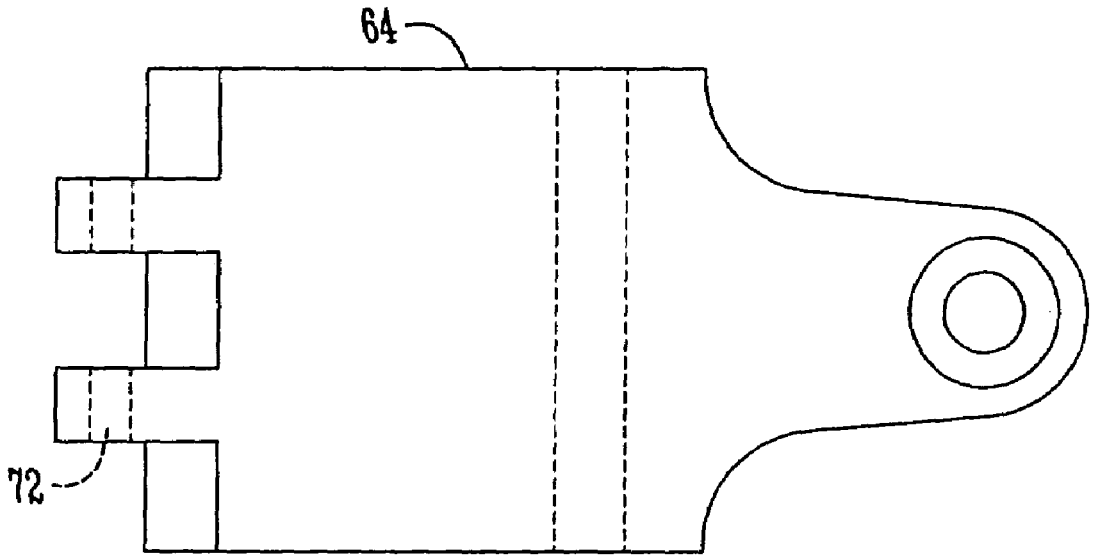
FIG. 9 shows a bottom view of the iron cap main body.
Figure 10:
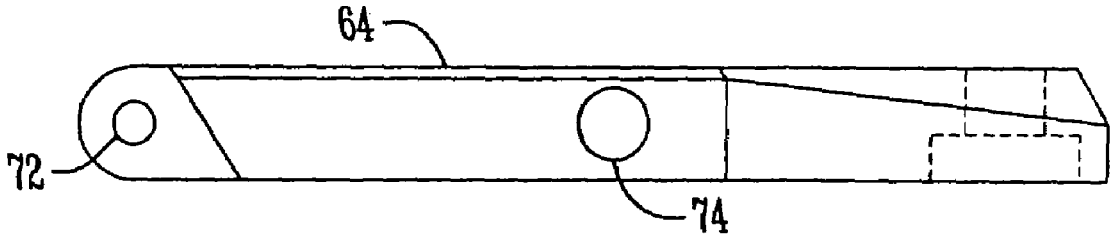
FIG. 10 shows a side view of the iron cap main body.

FIGS. 9 and 10 show the bottom view and the side view respectively of the iron cap main body. The name iron cap does not refer to the material makeup of the preferred embodiment of the current invention. Rather, iron cap simply is the name given for the cap which covers the iron 28A or 28B otherwise known as the blade for the plane. Calling the blade the iron is standard in the art and thus, the cap covering the iron is commonly known as the cap iron. Therefore, the articulated iron cap can be made of any rigid material.

This invention refers to loading of the plane iron. Loading simply means applying pressure against the iron so as to push the lower end of the iron down and back towards the rear of the throat of the base unit with pressure similar to the pressure that would be applied as the iron is driven into the wood in which it is to cut where the wood would be pushing against the lower edge or the cutting edge of the iron. The current invention allows for the iron 28A or 28B to be pre-loaded to a force far greater than the load force of standard hand planes, thereby significantly reducing any flexing or vibrating of the iron 28A or 28B during use. The pre-loading of the iron 28A or 28B in the current invention allows for a much smoother cut because the iron 28A or 28B does not flex when it is driven into the wood that is being worked. In addition, this pre-loading force allows the depth of cut to be adjusted by adding more loading force to the iron 28A or 28B by further tightening the tensioning bolt 62. In fact, the depth of cut can be adjusted by approximately 0.003" (0.0762 mm) in this manner.

Figure 11A:
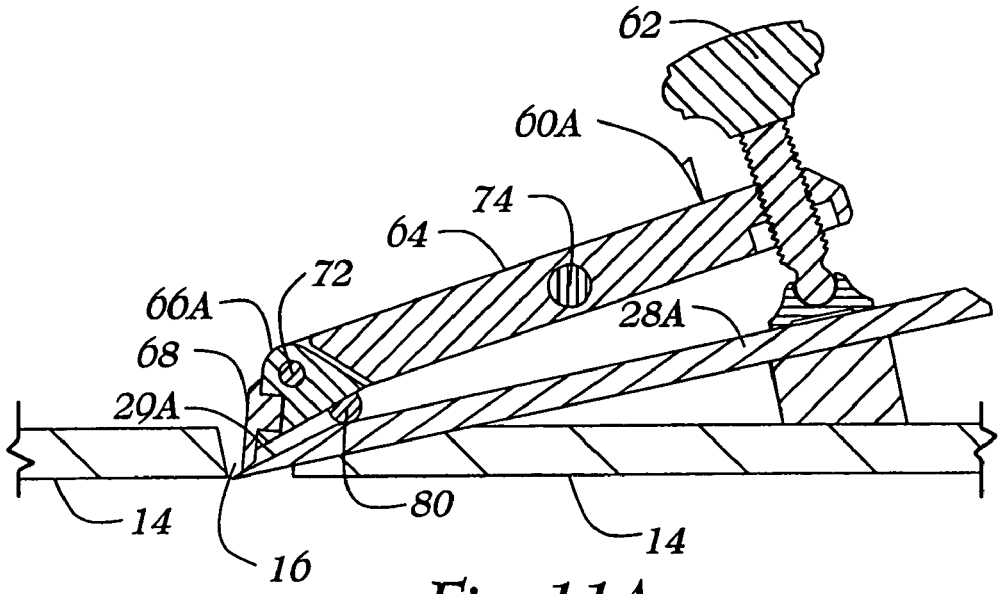
FIG. 11A shows a sectional view through the center of a bevel up plane using the current invention.
Figure 11B:
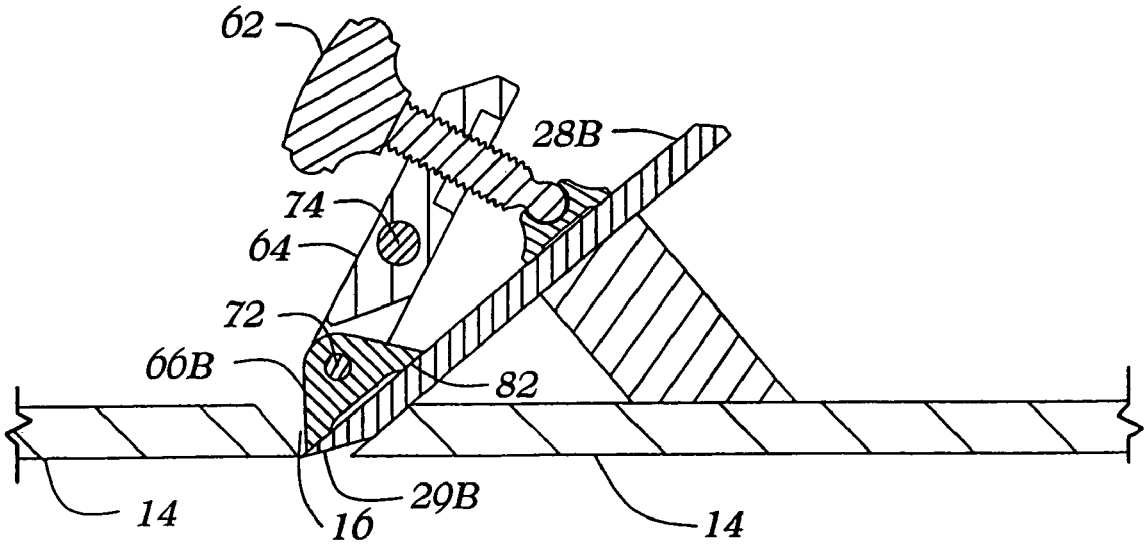
FIG. 11B shows a sectional view through the center of a bevel down plane using the current invention.

FIGS. 11A and 11B show sectional views of the articulated iron cap assembly 60A and 60B respectfully. This view shows how the loading of the iron 28A and 28B takes place near the cutting edge of the iron 28A and 28B. As the tensioning bolt 62 is tightened, the iron cap assembly 60A and 60B pivot about both the iron cap assembly main pivot points 74 and the chip breaker pivot 72 to allow the chip breaker 66A and 66B to self-align with the angle of the iron 28A and 28B.

Figure 11C:
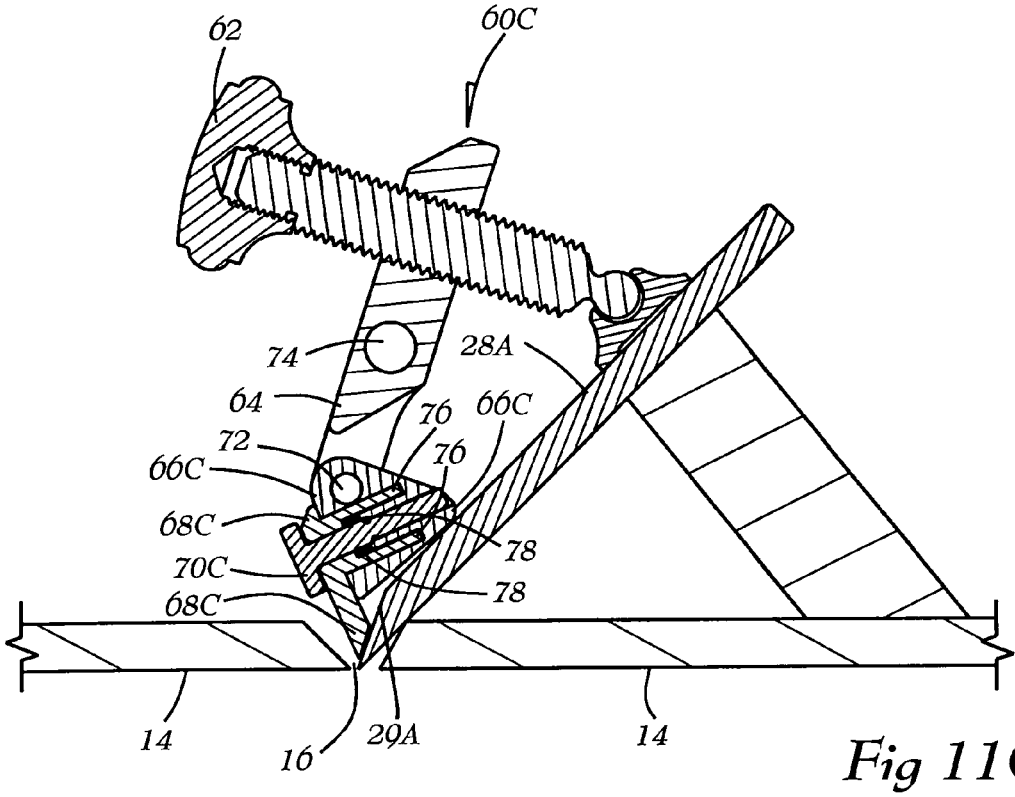
FIG. 11C shows a partial sectional view of another embodiment of the current invention along lines 11C in FIG. 6C.
Figure 11D:
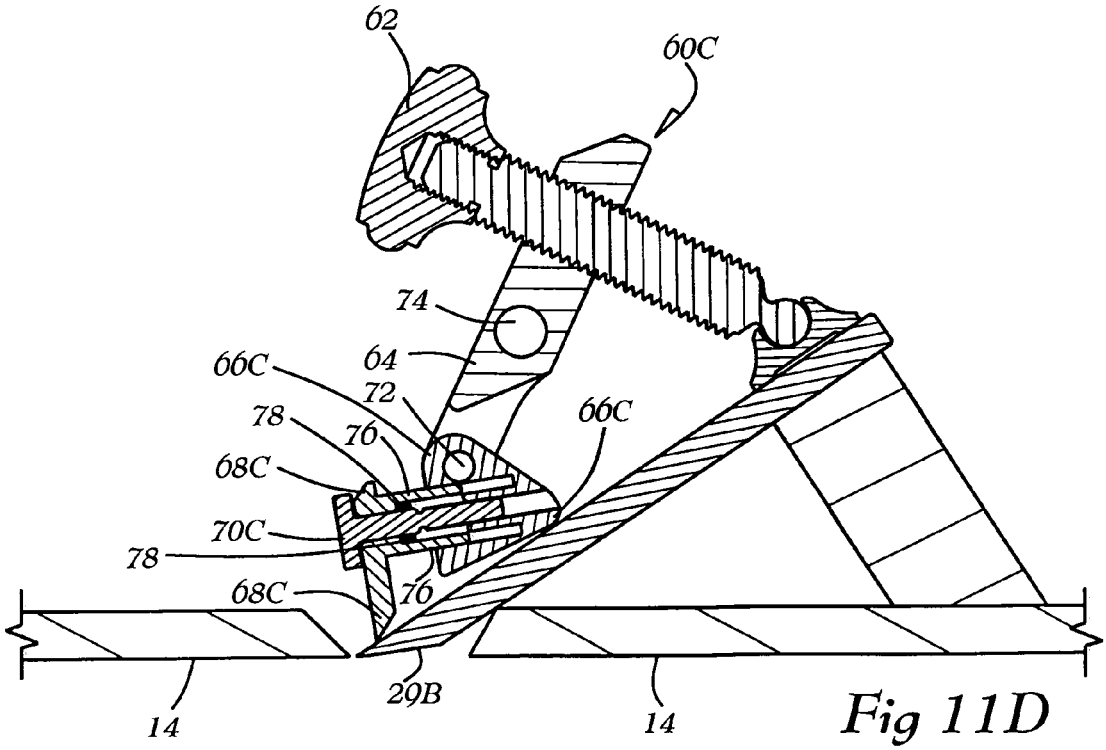
FIG. 11D shows a partial sectional view of another embodiment of the current invention along lines 11D in FIG. 6D.

Similarly, FIGS. 11C and 11D show sectional views of the articulated iron cap assembly with extendible nose 60C. These views show the loading of the iron 28 with nose piece pressure bar 68C extended and retracted. The pressure bar 68C is extended in and out by a threaded extendible nose pivot 70C. The pivot 70C threads into the dampner 66C. It is preferred that the pivot 70C be knurled or ribbed for ease of turning, but a screw head, hex head, or other device can be used for turning the pivot 70C. A retaining ring 78 around the nose pivot 70C houses both the pivot 70C and the pressure bar 68C to extend in and out together. The pressure bar 68C also has an extendible nose barrel 76 which keeps the pressure bar 68C properly aligned with respect to the dampner 66C and also provides strength for loading the iron 28. In use, the extendible nose cap assembly 60C works similar to articulated iron cap assemblies 60A and 60B.

The sound made by the preferred embodiment of the current invention during use is different from the sound made by traditional planes. The additional tension or loading on the iron 28A and 28B and the additional mass added near the bevel 29A and 29B edge changes the natural frequency of the plane. This in turn changes the pitch (sound) and contributes to a reduction in the iron resonating (vibrating). The result is that a reduction in force is needed to work the plane and the iron 29A and 29B stays sharp longer.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstance may suggest or render expedient without departing from the spirit or scope of the invention as further defined in the following claims.

What is claimed is:

1. A hand plane combination comprising:

a base having a sole and a throat, and having forward and rearward ends;

an iron on the base and having a beveled edge extending through the throat of the base, and having opposite forward and rearward sides;

an iron cap pivotally mounted to the base on the forward side of the iron the pivotal mounting being about a horizontal axis extending perpendicular to the forward and rearward directions;

a chip breaker pivotally mounted to the iron cap on the forward side of the iron and adjacent to the beveled edge; and an extendible pressure bar on the chip breaker which moves in and out from the chip breaker for engaging the iron adjacent the throat and dampening vibration in the iron, the pressure bar extending generally across a width of the iron adjacent to the beveled edge.

2. The hand plane combination of claim 1 wherein the iron is configured as an up-beveled iron.

3. The hand plane combination of claim 1 wherein the iron is configured as a down-beveled iron.

4. The hand plane combination of claim 1 wherein the pressure bar self-aligns with a grind angle on the iron.

5. A hand plane comprising:

a base having a sole and a throat and a longitudinal axis;

an iron on the base, the iron having a beveled edge extending through the throat of the base;

an iron cap pivotally mounting to the base about a horizontal axis extending perpendicular to the longitudinal axis;

a chip breaker pivotally connected to the iron cap and adjacent to the beveled edge;

the iron cap and the chip breaker both being on one side of the iron; and a pressure bar adjustably mounted on the chip breaker, which moves in and out from the chip breaker to engage the iron and apply adjustable pressure to the iron, the pressure bar extending generally across a width of the iron adjacent to the beveled edge of the hand plane.

6. The hand plane of claim 5 whereas the cap is configured to mate to a bevel up iron.

7. The hand plane of claim 5 whereas the cap is configured to mate to a bevel down iron.

8. The hand plane of claim 5 wherein the chip breaker pivots approximately perpendicular to the longitudinal axis of the hand plane.

9. The hand plane of claim 8 wherein the pressure bar is pivotal so as to align with a grind angle on the iron.

* * * * *